United States Patent [19]

Kamiyama et al.

[11] 4,436,414

[45] Mar. 13, 1984

[54] TONER COLLECTION DEVICE

[75] Inventors: Shin-ichi Kamiyama, Yokohama; Yutaka Hasegawa, Tokyo, both of Japan

[73] Assignee: Ricoh Company, Ltd., Japan

[21] Appl. No.: 420,864

[22] Filed: Sep. 21, 1982

[30] Foreign Application Priority Data

Sep. 25, 1981 [JP] Japan ..... 56-152327
Sep. 25, 1981 [JP] Japan ..... 56-152328
Sep. 25, 1981 [JP] Japan ..... 56-152329

[51] Int. Cl.[3] ..... G03G 15/08

[52] U.S. Cl. ..... 355/15; 355/3 DD; 430/125; 118/652; 15/256.52

[58] Field of Search ..... 355/15, 3 DD, 14 D; 118/652; 430/125; 15/256.51, 256.52

[56] References Cited

U.S. PATENT DOCUMENTS 3,742,551 7/1973 Oriel ..... 15/256.51
3,924,566 12/1975 Dennie ..... 355/15 X
4,145,137 3/1979 Sunaga et al. ..... 355/15
4,218,132 8/1980 Iwai et al. ..... 355/15
4,251,155 2/1981 Schnall et al. ..... 355/15

*Primary Examiner*—A. C. Prescott
*Attorney, Agent, or Firm*—Guy W. Shoup

[57] ABSTRACT

A toner collection device including a toner container for collecting therein toner is provided. The present device includes a toner container provided with an inlet opening through which toner is collected, a container holder generally in the shape of a tray for holding thereon said container and means for moving said holder and container in a predetermined fashion. That is, in accordance with the present invention, the container is subjected to a periodic rocking motion such that it moves at an accelerated speed when directed in a predetermined direction and it moves at a slower speed in its returning motion. Thus, when the container is suddenly halted at the end of the going stroke, a heap of toner formed inside the container collapses to make room for further incoming toner. As a result, the packing density of the toner into the container is always insured to be above a predetermined level.

10 Claims, 9 Drawing Figures

TONER COLLECTION DEVICE

BACKGROUND OF THE INVENTION

1. Field of the Invention

This invention relates to a toner collection device and, in particular, to a device for collecting the toner which has been removed from the surface of a photosensitive member after image transfer for use in an electrophotographic copying machine.

2. Descripion of the Prior Art

In a transfer type electrophotographic copying machine, some toner will remain on the surface of the photosensitive member after the image transfer step, and such residual toner must be removed from the surface prior to the initiation of the next following copying process. The residual toner thus removed is then collected in a toner collecting container which is detachably installed in the copying machine.

Such a toner collecting container is usually in the shape of a bottle or box provided with an opening at its top. The toner removed from the photosensitive member is guided into the opening and thus the toner will fall by its own weight toward the bottom of the container. However, since the toner will fall onto the same point, there will soon be formed a heap and its apex will block the opening to hinder further collection of toner even if there is still some room inside the container.

One prior art approach to cope with this problem is to make the toner falling distance long. However, this approach is not always advantageous because it requires to make a vertically elongated container which may not be used in compact machines such as desk-top type machines. Another prior art approach is to maintain the toner collecting container in constant vibration so as to decrease the height of the heap by spreading the collected toner sideways. This second approach, however, creates a noise problem and it requires a significant amount of power to substantially flatten the toner surface inside the container. Furthermore, design of the container is rather limited because an opening must be usually located at the center in order to attain efficient spreading of the collected toner. Even in this second approach, there still remains difficulty in using a laterally elongated container.

It is desirous to provide such a toner collecting container detachably because it will become full when the copying operation is carried out repetitively. Thus, it is desirous to provide a structure which will indicate the state that the container has become full to the operator. Furthermore, when the container is provided to be detachable, it is desirous that the operator be warned if no container is installed in position in order to prevent the toner removed from the photosensitive member from being scattered in the machine. None of the prior art devices is satisfactory in meeting all these conditions, and, thus, there has been a need for providing an improved toner collecting device.

SUMMARY OF THE INVENTION

The disadvantages of the prior art are overcome with the present invention and an improved device for collecting toner particles is hereby provided.

In accordance with one aspect of the present invention, there is provided a toner collecting device which comprises: a container provided with an opening through which toner is collected therein; a holder generally in the shape of a tray for holding said container; and rocking means for rocking said holder back and forth such that said holder moves at an accelerated speed while being rocked in a predetermined direction and moves at a slower speed while being rocked back to the original position.

In accordance with another aspect of the present invention, there is provided a toner collecting device which comprises: a container provided with an opening through which toner is collected therein; a holder generally in the shape of a tray for holding said container; rocking means for rocking said holder back and forth such that said holder moves at an accelerated speed while being rocked in a predetermined direction and moves at a slower speed while being rocked back to the original position; detecting means for detecting at least the condition when said container has collected toner beyond a predetermined amount; and gate means for allowing to pass a detection signal from said detecting means only when said rocking means is held inoperative.

The advantages of the present invention are preferably attained by intermittently rocking or swinging the toner collecting container such that the inertia acting on the apex portion of the toner heap is sufficiently large to destroy the heap thereby moving the thus destroyed apex portion toward the deeper end of the container. As different from the prior art vibration technique, the application of the rocking motion to the container in accordance with the present invention is very effective in spreading the toner inside the container and yet it does not require consumption of large power. It is to be noted that there is a high degree of freedom in designing a container in accordance with the present invention since the direction of rocking motion may be arbitrarily selected in view of other considerations. Accordingly, the present invention has a wide range of application.

Therefore, it is a general object of the present invention to provide an improved toner collecting device.

Another object of the present invention is to provide a toner collecting device which may be applied advantageously to a transfer type electrophotographic copying machine.

A further object of the present invention is to provide a toner collecting device allowing to fill the toner container substantially fully.

A still further object of the present invention is to provide a toner collecting device capable of indicating the overweight condition of the toner container.

A still further object of the present invention is to provide a toner collecting device capable of indicating the presence and absence of a toner container in a predetermined position.

A still further object of the present invention is to provide a toner collecting device which allows to supply a detection signal indicating the overweight condition only when the toner collecting device is not in rocking motion thereby eliminating the possible occurrence of faulty detection operation.

A still further object of the present invention is to provide a toner collecting device which has a wide range of applicability.

Other objects, advantages and novel features of the present invention will become apparent from the following detailed description of the invention when considered in conjunction with the accompanying drawings.

DESCRIPTION OF THE PREFERRED EMBODIMENTS

Figure 1:
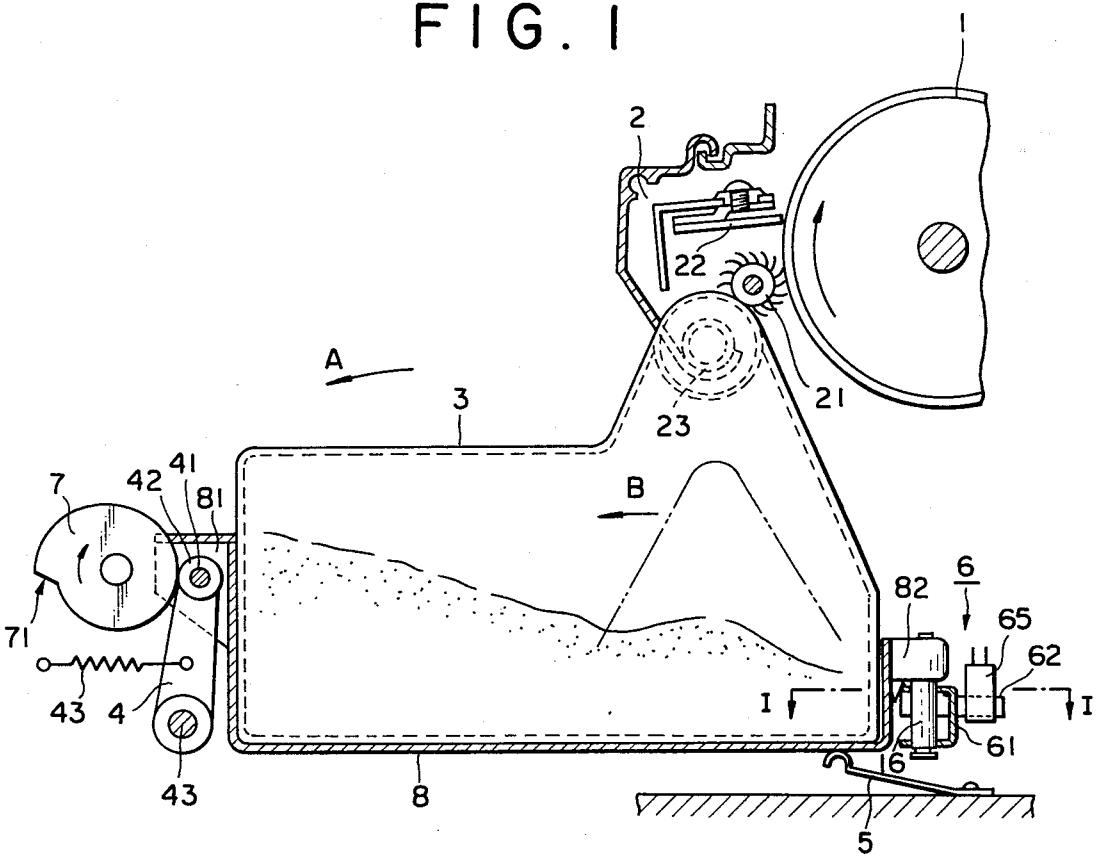
FIG. 1 is a schematic illustration showing the overall structure of the toner collecting device embodying the present invention.

Referring now to FIG. 1, there is shown a toner collecting device embodying the present invention, which is shown as an example to be provided in an electrophotographic copying machine. As shown, a photosensitive drum 1, which is journaled in a machine housing (not shown), is driven to rotate at a constant speed in the direction indicated by the arrow, and, according to the well-known electrophotographic process, on the peripheral surface of the drum 1 is formed a toner image which is then transferred to a transfer medium at a transfer station (not shown). Then the thus transferred image is fixed to the transfer medium to form a copy image thereon. On the other hand, in the downstream of the transfer station is provided a cleaning device 2 for removing the residual toner from the surface of the drum 1 for preparing the drum 1 for the next cycle of operation.

In the embodiment shown in FIG. 1, the cleaning device 2 includes a fur-brush cleaner 21 and a blade cleaner 22 which is located downstream of the fur-brush cleaner 21. The toner particles remaining on the drum surface after the transfer step, therefore, are removed from the drum surface at the cleaning station and they are transported to a discharge pipe 23 which is provided at one end of the cleaning device 2, for example, by an auger screw (not shown) which is provided at the bottom of the cleaning device 2 to transport the removed toner to the pipe 23. The toner thus removed will then be collected into a container of the present toner collecting device as will be described in detail in the following.

Figure 2:
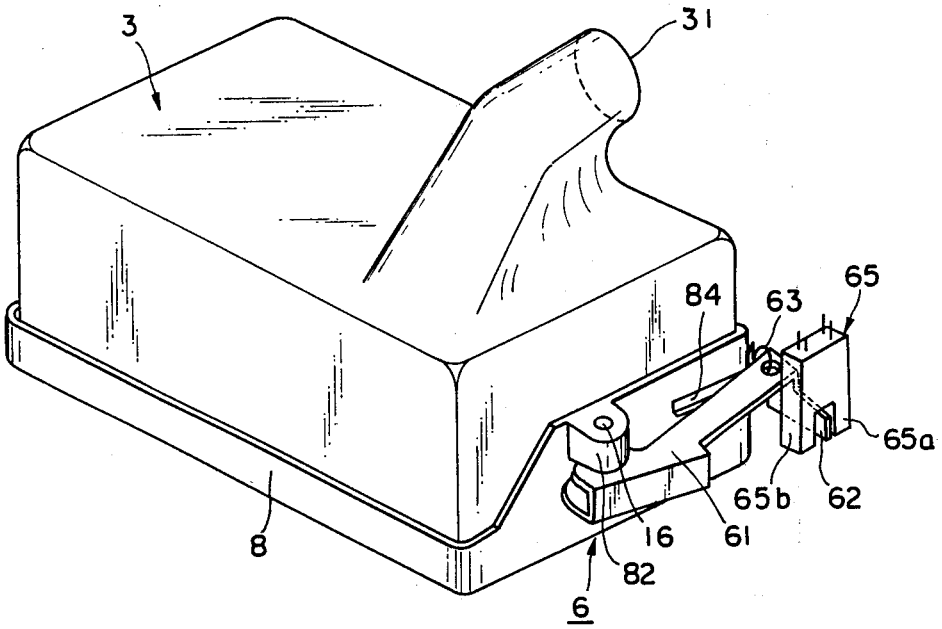
FIG. 2 is a perspective view showing the device of FIG. 1.

The toner collecting device of the present invention includes a container 3 for collecting toner therein. As best shown in FIG. 2, the container 3 is generally in the shape of a box having a raised portion provided with an opening 31 at top. The forward end of the pipe 23 may be loosely fitted into the inlet opening 31 of the container 3 and thus the toner discharged out of the pipe 23 is fed into the container 3. In this particular embodiment, the raised portion and thus the inlet opening 31 is positioned closer to the right end wall of the container box 3. The container 3 is housed in a holder 8 which is generally in the shape of a tray. It is to be noted that, with such a structure, the container 3 may be easily replaced when it becomes full. Although it is preferable to structure the holder 8 as shown, it may have a different structure as long as it can hold the container thereon while the holder 8 together with the container 3 is subjected to rocking motion as will be described later.

Figure 5:
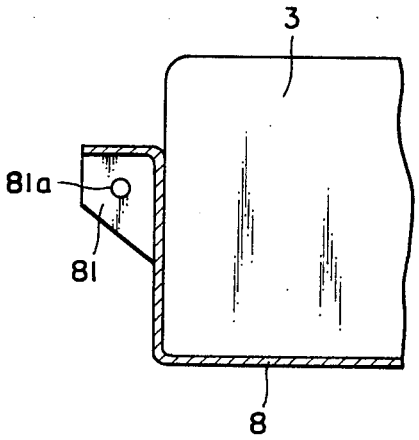
FIG. 5 is a schematic illustration showing a part of the present device.

The holder 8 is provided with a bracket 81 at its left end wall and a through-hole **81*a* is provided in the bracket 81 as shown in FIG. 5. A lever 4 is provided to pivot around a pin 43 which is securely supported by a machine housing (not shown). At the forward end of the lever 4 is fixedly planted a pin 41 which supports a cam follower 42 rotatably therearound. The pin 41 extends sufficiently long in the direction perpendicular to the plane of the drawing so that it is loosely fitted into the through-hole 81*a* thereby supporting the left end of the holder 8. There is also provided a profiled cam 7 which is supported by the machine housing to be driven to rotate in the direction indicated by the arrow. As shown, the cam 7 has a cam surface defined by its periphery which is generally in a spiral shape. That is, a step 71 is provided at the cam surface and the radius gradually increases from the bottom of the step 71 in the counter-clockwise direction until the top of the step 71. A spring 43 is provided to extend between the lever 4 and the machine housing to keep the cam follower 42 in rolling contact with the profiled cam 7. Also provided is a leaf spring 5 having one end fixedly attached to the machine housing and the opposite free end which supports the right end portion of the holder 8**.

In operation, when the cam 7 is driven to rotate by means of a motor (not shown) in the direction indicated by the arrow, the lever 4 pivots clockwise around the pin 43 via the cam follower 42 against the force of the spring 43 so that the holder, together with the container 3, is gradually moved or rocked to the right until the top of the step 71 comes around to the cam follower 42. Further rotation of the cam 7 causes the lever 4 to suddenly pivot counter-clockwise with an accelerated speed because the cam follower 42 moves from the top to the bottom of the step 71 as urged by the spring 43 as the cam 7 rotates. This causes the holder 8 and thus the container 3 to move or rock to the left as indicated by the arrow A at an accelerated speed which is much higher than the rocking speed to the right.

When the cam follower 42 reaches the bottom of the step 71, the rocking motion to the left is suddenly halted so that the inertia force acting at the apex portion of a toner heap formed inside the container 3, as indicated by the two-dotted line, causes that portion to be thrown to the left thereby forming more room for the incoming toner below the opening 31. A still further rotation of the cam 7 will now causes the holder 8 and the container 3 to rock to the right, but, as mentioned previously, the rocking motion to the right takes place at a slower speed and, therefore, the collected toner will not change position during this period. As will be appreciated, in accordance with the present invention, as soon as a heap of toner created inside the container 3 has reached a certain height, the accelerated rocking motion to the left and its sudden stoppage causes the heap to collapse thereby shifting a part of the heap deeper into the container to make room for further incoming toner around the inlet opening 31. Therefore, the packing density of the container 3 is always insured to reach a predetermined level.

It is to be noted that the present toner collecting device may be applied to any image forming apparatus such as an electrostatic or magnetic recording apparatus not to mention a copying apparatus as described above. Furthermore, the rocking means for intermittently moving the container 3 in a predetermined direction at an accelerated speed and bringing it to a halt suddenly may be comprised of any structure known to those skilled in the art; for example, it may be constructed by using an electromagnet instead of a cam.

Referring back to FIG. 1, a detecting mechanism generally indicated by the reference numeral 6 is provided at the right end wall of the holder 8. As shown, a projection 82 is provided integrally with the holder 8 and a support pin 16 is fixedly planted in the projection 82 to extend downward therefrom. A detection lever 61 is provided to be pivotal around the support pin 16 and a stopper (not shown) is provided at the tip end of the support pin 16 to prevent the detection lever 61 from slipping away. A shutter member 62 is provided at the forward end of the detection lever 61 as a unit. If desired, the shutter member 62 may be integrally formed with the lever 61. The shutter member 62 extends generally in the direction perpendicular to the lengthwise direction of the detection lever 61.

Also provided is a photoelectric detector 65 which is fixedly mounted on the machine housing and which has a pair of legs 65*a* and 65*b* extending downward as spaced apart from each other. The leg 65*a* includes a light emitting element such as a light emitting diode which projects light toward the other leg 65*b* which includes a photoelectric detecting element such as a photodiode to receive the light projected thereto. Thus a light path is defined between the legs 65*a* and 65*b*. As may be noticed already, the detector 65 is positioned such that the forward portion of the shutter member 62 may be inserted between the legs 65*a* and 65*b* when the detection lever 61 pivots clockwise thereby causing the light path to be blocked. A spring 63 is provided to extend between the forward end of the lever 61 and a projection 83, which is integrally provided on the side wall of the holder 8. Thus the detection lever 61 is normally urged to pivot in the counter-clockwise direction around the support pin 16. It is also to be noted that, in the particular embodiment disclosed herein, a notch 84 is formed at the top right corner of the holder 8 extending horizontally along the end and side walls. The provision of such a notch 84 allows a part of the detection lever 61 to move into the space defined for installation of the container 3 into the holder 8.

Figure 6:
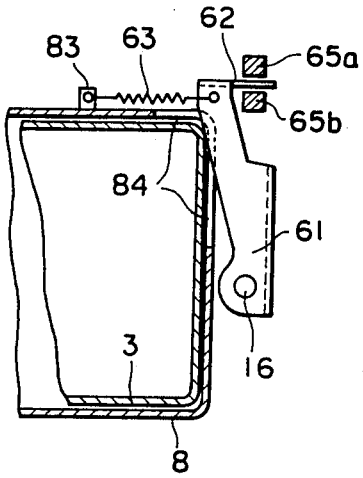
FIG. 6 is a schematic illustration showing the condition that the detecting mechanism of the present invention detects the presence of the container 3 in position.
Figure 7:
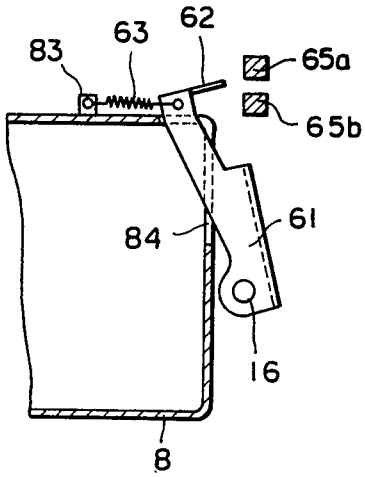
FIG. 7 is a schematic illustration showing the condition that the detecting mechanism of the present invention detects the absence of a container to be provided in a predetermined position.

The detecting mechanism 6 has a dual function and, in the first place, it detects the presence or absence of the container 3 in the holder 8. .This aspect will be best explained with reference to FIGS. 6 and 7. That is, when the container 3 is properly installed in the holder 8 as illustrated in FIG. 6, the wall of the container 3 pushes the detection lever out of the installation space and, therefore, the detection lever 61 pivots clockwise around the pin 16 against the force of the spring 63 to have the shutter member 62 located between the legs 65*a* and 65*b* thereby blocking the light path therebetween. Thus no detection signal is supplied. On the other hand, in the case of absence of the container 3 in the holder 8 as shown in FIG. 7, the detection lever 61 is rotated around the pin 16 by means of the recovery force of the spring 63 and it partly moves into the installation space for the container 3 until it engages with wall of the notch 84. As a result, the shutter member 62 comes to be pulled away from the optical path defined between the legs 65*a* and 65*b*. Therefore, a detection signal is produced from the detector 65 and such a signal may be used to illuminate an indicator (not shown) indicating the absence of a container in the holder 8.

Figure 3:
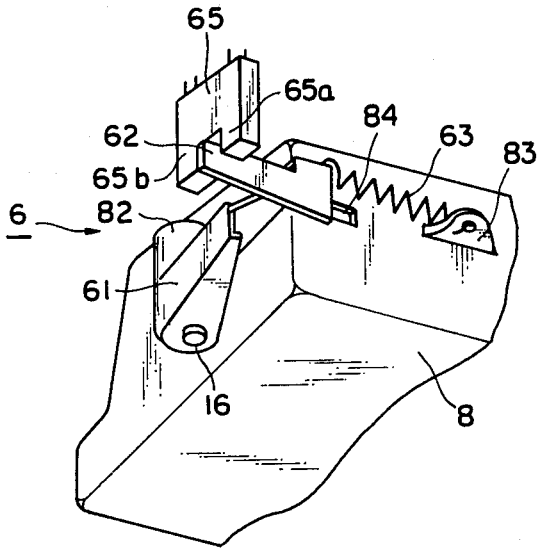
FIG. 3 is a perspective view showing mainly the detecting mechanism provided in the device of FIG. 1.
Figure 4:
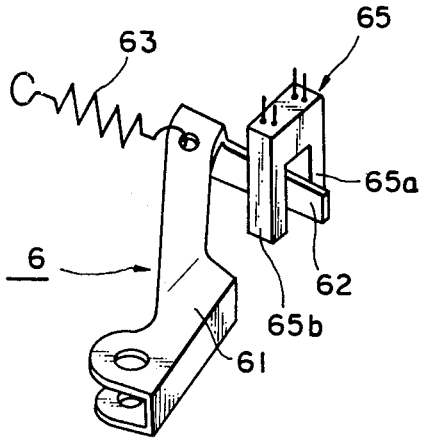
FIG. 4 is a schematic illustration showing the detailed structure of the detecting mechanism in perspective.

Now, a second function of the detecting mechanism 6 will be explained with particular reference to FIGS. 2 to 4. In the case when the container 3 is properly installed in the holder 8 as shown in FIG. 2, the detection lever 61 is pivotted clockwise over a predetermined angle by engagement with the wall of the container 3 as described above. Under the condition, the shutter member 62 is located such that it blocks the light path defined between the detection legs 65*a* and 65*b*. Accordingly, no detection signal is produced. It should however be noted that the end of the holder 8 where the detecting mechanism 6 is provided is supported resiliently by the leaf spring 5. Thus, as the container 3 collects more toner, the holder 8, together with the shutter member 62, gradually moves downward against the recovery force of the spring 5. And eventually the shutter member 62 will be moved away from the detector 65 in the downward direction to allow establishment of the light path between the detecting legs 65*a* and 65*b*. As a result, a detection signal indicating that the amount of the toner collected in the container 3 has reached a predetermined level, i.e., overweight condition, is produced from the detector 65, and such a signal may be used to illuminate an overweight indicator which may be provided appropriately to warn the operator.

Although the above-described embodiment is a preferred detecting mechanism, it should be noted that the present invention is not limited to the described structure alone. For example, such a detecting mechanism may be applied to other types of image forming apparatus such as electrostatic or magnetic recording apparatus using toner for developing a latent image. Moreover, the detecting mechanism 6 is not limited to a photoelectric structure as described above. Other possible alternatives are the structures using reed switches, Hall-effect devices, feeler switches, microswitches, etc.

Figure 8:
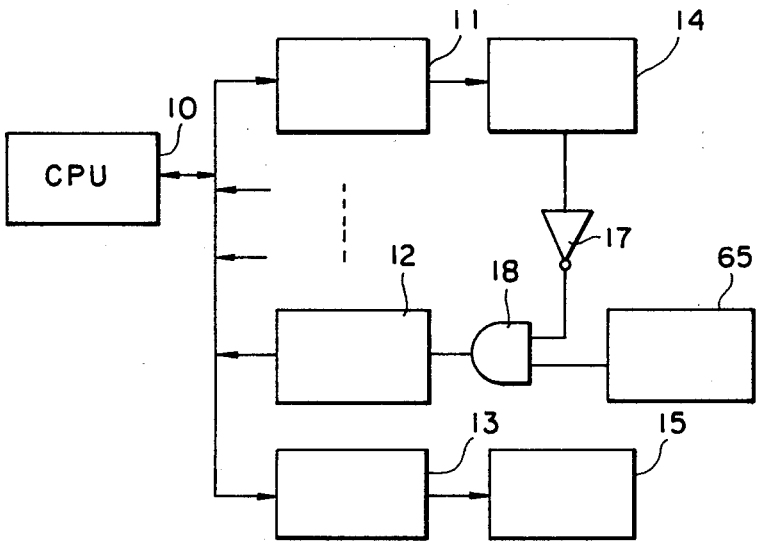
FIG. 8 is a block diagram showing the detecting system to be provided in the present toner collecting device which prevents the faulty detecting operation from occurring.
Figure 9:
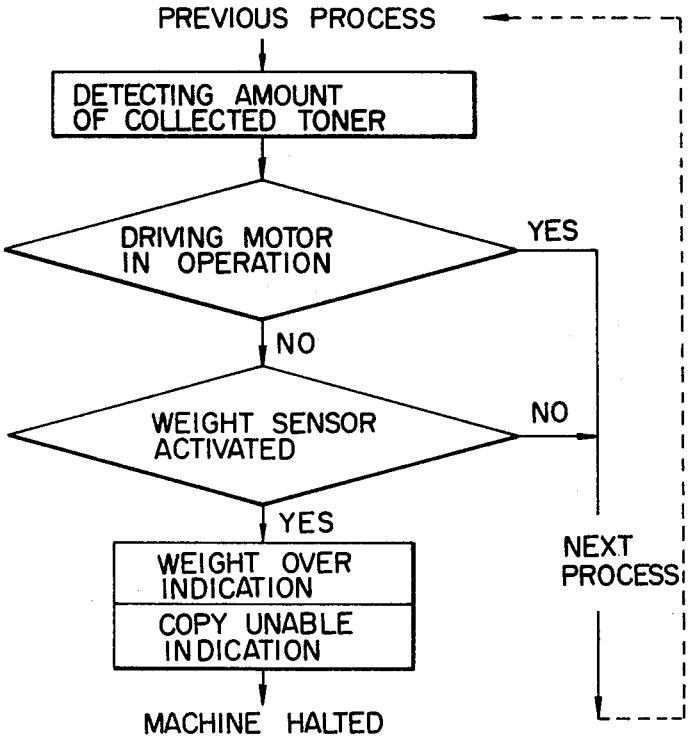
FIG. 9 is a flow chart showing the sequence of steps to be carried out in the system shown in FIG. 8.

FIG. 8 shows the system for detecting and indicating the overweight condition of the toner container 3 when applied to a copying machine. As shown, the system includes a central processing unit (hereinafter simply referred to as "CPU") 10 which controls the operation of each component in the machine. The CPU 10 is connected to a driving signal output port 11 which, in turn, is connected to a driving circuit 14 for driving a main motor of the machine. The driving circuit is connected to the input of an inverter 17 which has its output connected to one input of an AND gate 18, the other input of which is connected from the photoelectric detector 65. The outout of the AND gate 18 is connected to a detection signal input port 12 which in turn is connected to the CPU 10. Also shown is an indicator 15 for indicating the overweight status, which is connected from the CPU 10 through a overweight signal output port 13.

Explained the operation of the system shown in FIG. 8, while the main motor (not shown) is driven to rotate by the driving circuit 14, the photosensitive drum 1 rotates and it is subjected to a series of well-known image forming steps such as uniform charging, light image exposure, developing and transferring. At the same time, the cam 7 is also driven to rotate as driven by the main motor through a transmission mechanism (not shown). Accordingly, while the machine is in reproduction operation, the present toner collecting device is also set in operation and thus the container 3 is intermittently set in a biased rocking motion so as to obtain enhanced filling of toner. During such a period, the holder 8 also moves up and down, and there is a chance that the shutter member 62 temporarily moves out of the photodetector 65 to give a false detection signal. However, in the system shown in FIG. 8, it is so structured that a low level signal is applied to one input of the AND gate 18 during the period while the main motor is in operation. And, therefore, even if a false detection signal, as explained above, is supplied to the other input of the AND gate 18, it is prevented from being supplied to the CPU 10 so that such a false signal is neglected, thereby preventing the occurrence of faulty detecting operation.

When the drive of the main motor ceases upon termination of the reproduction process, a high level signal is applied to one input of the AND gate 18. Under the condition, if the container 3 is half full, the detector 65 supplies a low level signal to the other input of the AND gate 18 and thus the CPU 10 is apprised of the fact that more toner can be collected in the container 3. On the other hand, if the amount of the toner collected in the container 3 has reached or exceeded a predetermined level, the shutter member 62 comes to be located below the defined light path and thus the detector now supplies a high level detection signal to the other input of the AND gate 18. This satisfies the AND condition so that the AND gate 18 supplies an overweight signal to the CPU 10 via the port 12. In response thereto, the CPU 10 controls the subsequent operation of the main motor and at the same time supplies an overweight signal to the overweight indicator 15 via the port 13. It may be so structured that the main motor can be driven only when the container 3 filled with toner has been replaced by an empty container, if desired. It is to be noted that, in accordance with the present invention, it is structured such that the detection of overweight is carried out while the toner collecting device is still whereby faulty detecting operation is prevented from occurring.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A toner collecting device comprising:

a container provided with an opening through which toner is collected therein;

a holder generally in the shape of a tray for holding said container; and rocking means for rocking said holder back and forth such that said holder moves at an accelerated speed while being rocked in a predetermined direction and moves at a slower speed while being rocked back to the original position.

2. The device of claim 1 wherein said rocking means includes a profiled cam driven to rotate and having a step along its peripheral surface, said profiled cam being disposed at one end of said holder, a cam follower rotatably supported by said holder and urging means for urging said cam follower against said profiled cam.

3. The device of claim 2 wherein said profiled cam is profiled such that its radius gradually increases from the bottom of said step in the direction of rotation to the top of said step whereby an acute slope is provided to connect the top and bottom of said step.

4. The device of claim 1 further comprising detecting means for detecting the presence and absence of said container in said holder and at the same time the overweight of the toner collected in said container.

5. The device of claim 4 wherein said detecting means includes a photoelectric element, a light-emitting element for projecting light toward said photoelectric element, a shutter member movable in two directions to be located in or out of the optical path defined between said photoelectric and light-emitting elements, first control means for controlling the movement of said shutter member along a first direction and second control means for controlling the movement of said shutter member along a second direction different from said first direction.

6. The device of claim 5 wherein said first control means includes a lever having a base portion pivotally supported by said holder and a forward portion for supporting said shutter member and urging means for urging at least a part of said lever located in the installation space defined by said holder for holding therein said container whereby said lever is pushed out of the installation space in engagement with said container when it is installed in position thereby causing said shutter member to be located to block the optical path between said photoelectric and light-emitting elements.

7. The device of claim 5 wherein said second control means includes resilient means for supporting said holder vertically movably whereby when said container has collected toner beyond a predetermined level, the weight of thus collected toner causes to move said holder together with said shutter member downward to locate said shutter member out of the optical path between said photoelectric and light-emitting elements .

8. The device of claim 7 wherein said resilient means is a spring fixedly provided on a machine housing to support the bottom of said holder.

9. A toner collecting device comprising:

a container provided with an opening through which toner is collected therein;

a holder generally in the shape of a tray for holding said container;

rocking means for rocking said holder back and forth such that said holder moves at an accelerated speed while being rocked in a predetermined direction and moves at a slower speed while being rocked back to the original position;

detecting means for detecting the condition when said container has collected toner beyond a predetermined amount; and gate means for allowing to pass a detection signal from said detecting means only when said rocking means is held inoperative.

10. The device of claim 9 further comprising driving means for driving said rocking means, and said gate means includes an AND gate having a first input connected from said driving means and a second input connected from said detecting means whereby a high level signal is applied to said first input when said driving means is inoperative and a detection signal of high level is applied to said second input when said detecting means has detected the overweight condition.

* * * * *